United States Patent [19]

Webinger

[11] 4,340,169

[45] Jul. 20, 1982

[54] COLLAPSIBLE TRAY

[75] Inventor: George P. Webinger, Robbinsdale, Minn.

[73] Assignee: Champion International Corporation, Stamford, Conn.

[21] Appl. No.: 240,572

[22] Filed: Mar. 4, 1981

[51] Int. Cl.[3] ..... B65D 5/24; B65D 5/46

[52] U.S. Cl. ..... 229/31 R; 229/41 B

[58] Field of Search ..... 229/31 R, 41 B, 16 R

[56] References Cited

U.S. PATENT DOCUMENTS

| | | | |
|---|---|---|---|
| 2,443,431 | 6/1948 | Ringler | 229/31 R |
| 3,289,914 | 12/1966 | Lange-Wiehe | 229/31 R |
| 3,386,644 | 6/1968 | Zachluni | 229/41 B |
| 3,904,106 | 9/1975 | Elder | 229/31 R |
| 4,088,261 | 5/1978 | Osborne | 229/31 R |
| 4,191,323 | 3/1980 | Welinger | 229/8 |
| 4,214,695 | 7/1980 | Cooper | 229/31 R |
| 4,306,658 | 12/1981 | Montealege | 229/31 R |

*Primary Examiner*—Herbert F. Ross

*Attorney, Agent, or Firm*—Evelyn M. Sommer

[57] ABSTRACT

A paperboard tray and a blank therefor is disclosed which is collapsible to form a carton. More specifically, the subject tray may be collapsed and sealed to hold a product and may then be subsequently opened and reformed into a tray for use in serving or cooking. A pair of handle flanges are provided defining carrying handles when the tray is opened and for structurally rigidifying the tray and preventing its inadvertent collapse.

11 Claims, 5 Drawing Figures

COLLAPSIBLE TRAY

BACKGROUND OF THE INVENTION

The present invention relates to a tray made of paperboard, or of ovenboard, if it is desired to use the tray for cooking in microwave ovens, and, in particular, to a tray that is collapsible and which, in its collapsed state, can be folded to form an enclosed carton.

In many cases it is desirable to have an open tray formed of paperboard, or ovenboard, from a tray blank which, if desired, could be collapsed and so folded that it becomes an enclosed carton. Such a case may occur where it may be desirable to package and ship a product in an enclosed carton which, after being received by the consumer, may be opened and unfolded in order to remove the contents, thus forming a tray in which the contents can be replaced, and the entire tray and its contents placed in the microwave oven for the necessary heating or cooking. In such case, the blank from which the tray is made would have to be of ovenboard to withstand the heat encountered in the microwave oven.

In other instances, however, it may be desirable to package a product and enclose it in the carton and ship it to the consumer who, upon receiving the enclosed carton, may prepare the contents thereof for use and then simply serve it or eat it from the tray which is formed when the carton is unfolded.

Most of the foods which are to be cooked in microwave ovens today come in a package from which they must be removed and placed in a second package which can be utilized in microwave ovens. Such a procedure is, of course, expensive because it requires two cartons in which to ship and to cook the product. In addition, it may even be necessary to remove the heated contents from the tray and serve it in an additional container. This would require three separate containers.

The present invention overcomes the disadvantage of the prior art by providing an enclosed carton in which the product may be shipped and sold to the consumer but which, upon receipt by the consumer, may be opened and unfolded to form a tray in which the product carried therein may be mixed and or cooked in the microwave oven and/or served. In such case, of course, as stated earlier, the material from which the collapsible tray is formed must be of a type that can withstand the heat generated in a microwave oven. An example of such a material is ovenboard.

In the prior art, one piece cartons are known which assume a tray-like configuration during intermediate stages of the erection operation. One example of such a carton can be found in U.S. Pat. No. 4,191,323, issued Mar. 4, 1980 to Webinger. The tray-like configuration facilitates loading of a product into the carton before it is sealed. However, since the latter carton is not intended to be used for cooking, the tray-like configuration is not continuous or sealed and therefore is incapable of functioning in suitable manner. Further, the tray-like configuration of the latter carton does not have the rigidity necessary to withstand the handling associated with a cooking operation.

Thus, it is an object of the present invention to provide a collapsible, yet structurally rigid tray into which a product may be placed, the tray folded to form an enclosed carton in which the product may be shipped and sold to a consumer and then unfolded to reform the tray in which the product may be either cooked or served or stored.

SUMMARY OF THE INVENTION

In accordance with these and other objects, the subject invention provides for a collapsible tray having a generally rectangular bottom wall defined by a center panel and two opposed bottom panels. A pair of upstanding end panels are hingedly connected to the opposed side edges of the bottom panels. The subject tray further includes a pair of upstanding side panels hingedly connected to the remaining edges of the bottom wall as well as to adjacent end panels. Each side panel is defined by a center section and two opposed side sections coextensive with the panels of the bottom wall. Each side section is provided with a diagonal fold to permit the tray to be collapsed into an enclosed carton. A pair of handle flanges are hingedly connected to the upper edges of each side panel. In use, the tray may be collapsed into an enclosed carton by upwardly folding the bottom panels of the bottom wall relative to the center panel thereof such that the bottom panels define the side walls of the enclosed carton. In this configuration, the end panels cooperate to define a continuous top wall, while the side sections of each side panel are folded inwardly about their respective diagonal fold lines and cooperate with the associated center section to define a triple-ply, end wall structure. When the tray configuration is reformed, the handle flanges are rotated outwardly relative to the side panels for maintaining the open configuration of the tray.

DESCRIPTION OF THE PREFERRED EMBODIMENT

Figure 2:
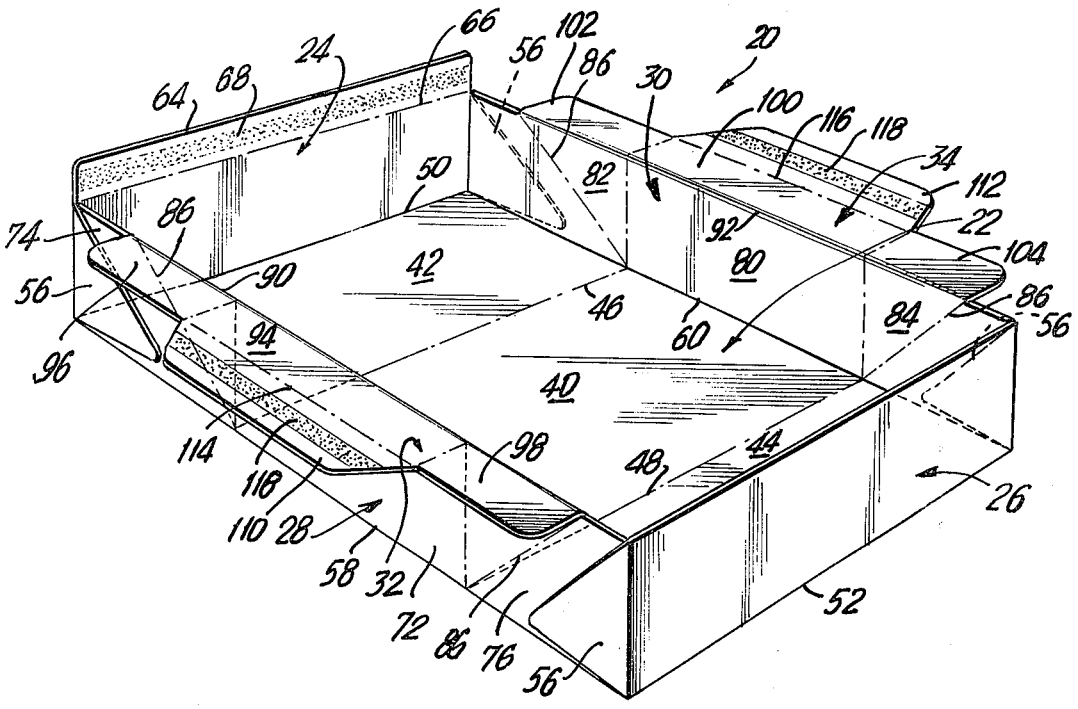
FIG. 2 is a perspective view of the new and improved collapsible tray of the subject invention in its erected position ready for use by the consumer.

Referring to FIG. 2, there is illustrated a new and improved collapsible tray 20 of the subject invention. Tray 20 includes a generally rectangular bottom wall 22 having first and second upstanding end panels 24 and 26 hingedly connected thereto at the opposed ends thereof. The collapsible tray 20 further includes a pair of opposed, first and second side panels 28, 30 hingedly connected to the remaining side edges of the bottom wall 22. A pair of outwardly projecting first and second handle flanges 32, 34 are provided to facilitate carrying of the tray and to structurally rigidify the tray, as more fully described hereinafter.

Figure 1:
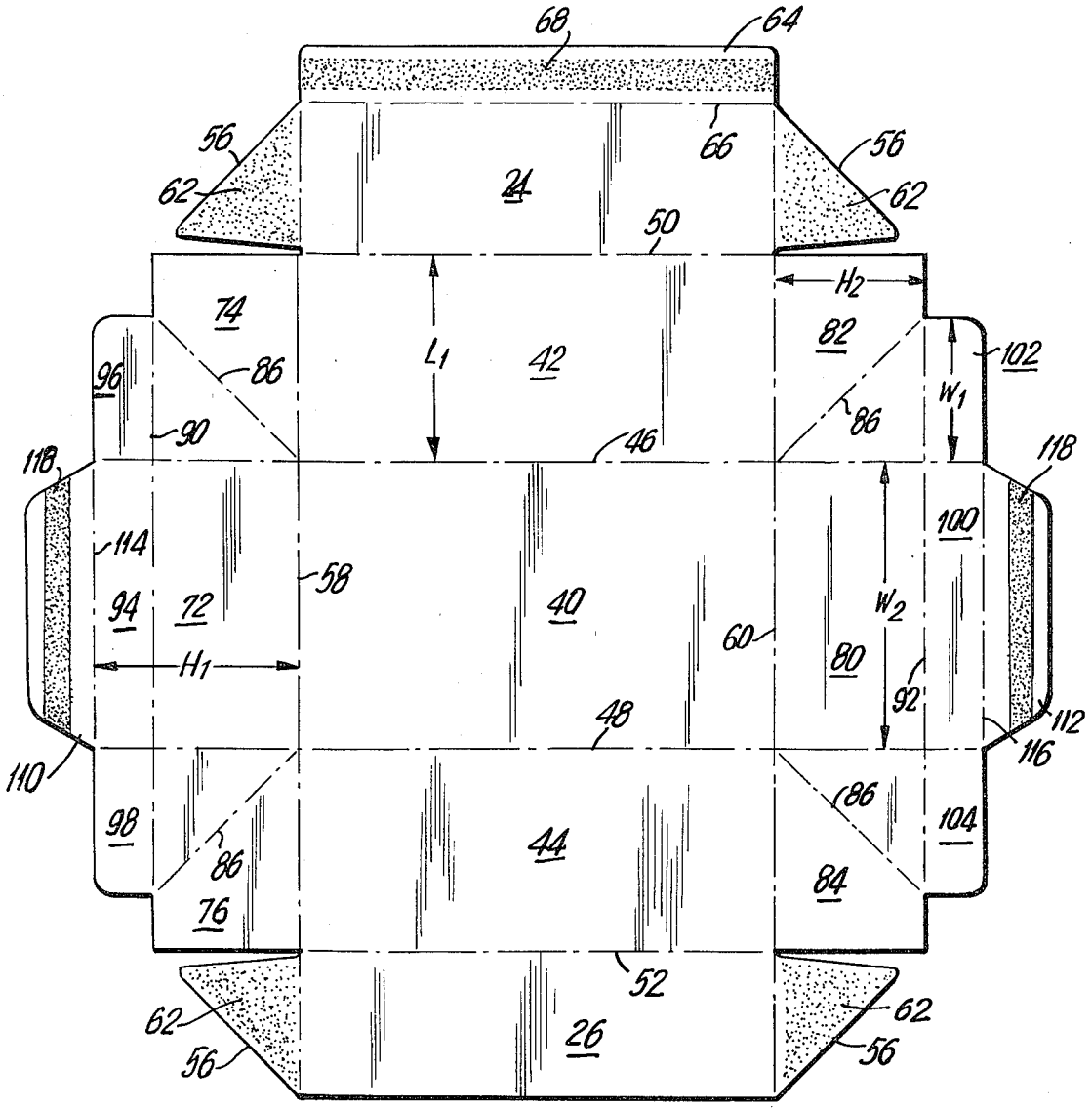
FIG. 1 is a plan view of the novel blank of the present invention from which the collapsible tray, which may be folded into a carton, is formed.

Referring now to FIG. 1, the blank 10 for forming the tray 20 of the subject invention is illustrated. Preferably, blank 10 is formed from a single sheet of paperboard material suitable for holding and cooking food. Bottom wall 22 of the subject blank 10 is defined by a center panel 40 and two opposed first and second bottom panels 42, 44, respectively. First and second bottom panels 42, 44 are hingedly connected to center panel 40 along fold lines 46 and 48. First and second end panels 24 and 26 are hingedly connected to the opposed free ends of bottom panels 42 and 44 along fold lines 50 and 52. A generally triangular glue tab 56 is hingedly connected to the opposed side edges of each end panel 24, 26 along fold lines 58 and 60. Glue tabs 56 may be provided with an adhesive 62 to facilitate the assembly of the tray 20. Preferably, a longitudinally extending glue flap 64 is hingedly connected to one of the end panels 24, along a fold line 64, and is provided with an adhesive 68.

As illustrated in FIG. 1, side panels 28 and 30 are hingedly connected to the opposed remaining edges of bottom wall 22 along fold lines 58 and 60, respectively. Each side panel is formed of three sections. More specifically, first side panel 28 includes a center section 72 which is coextensive with and hingedly connected to the center panel 40 of bottom wall 22. In addition, a pair of side sections 74 and 76 are provided and are hingedly connected to center section 72 along fold lines 46 and 48. Side sections 74 and 76 are coextensive with and hingedly connected to bottom panels 42 and 44 respectively. Second side panel 30 is identical in construction to first side panel 28 and includes a center section 80 as well as two opposed side sections 82 and 84. Each side section (74, 76, 82, 84) is provided with a diagonal fold line 86, extending from the intersection between the respective side section and the center panel 40 of bottom wall 22. Diagonal fold line 86 is provided to permit the tuck folding of the side sections during the collapsing of the tray, to form the enclosed carton of the subject invention.

First and second handle flanges 32, 34 are hingedly connected to first and second side panels 28 and 30 along fold lines 90 and 92, respectively. Each handle flange is also defined by three portions. More particularly, handle flange 32 includes a center portion 94 coextensive with and hingedly connected to the central section 72 of side wall 28. A pair of side portions 96 and 98 are hingedly connected to the opposed edges of center portion 94 along fold lines 46 and 48. Similarly, handle flange 34 includes center portion 100, as well as opposed side portions 102 and 104. Preferably, side portions 96, 98, (102, 104) are hingedly connected to and extend along a portion of the adjacent side sections 74, 76 (82, 84) and terminate at a point coincident with the end of diagonal fold line 86 formed therein. A pair of glue flaps 110 and 112 are hingedly connected to central sections 94 and 100 along fold lines 114 and 116, respectively. Glue flaps 110 and 112 may be provided with an adhesive 118 to facilitate the sealing of the carton.

The dimensions of the panels of the subject blank 10 may of course be varied depending on the size of the desired tray configuration. However, it is preferred that the length L1 of each bottom panel 42 substantially conform to the total height H1 of each side panel (28, 30) and handle flange (32, 34) combination. By this arrangement, when the tray is collapsed to form an enclosed carton, the end wall structure will extend the full height of the carton. It is also desirable that the height H2 of each side section (74, 76, 82, 84) be substantially equal to the width W1 of each side portion (96, 98, 102, 104). Further, it is preferable that each of these measurements (H2 and W1) extend approximately half the width W2 of the center sections 72, 80 of the side panels. By this arrangement, a relatively sturdy triple-ply end wall structure can be obtained, as more fully described hereinafter.

Figure 3:
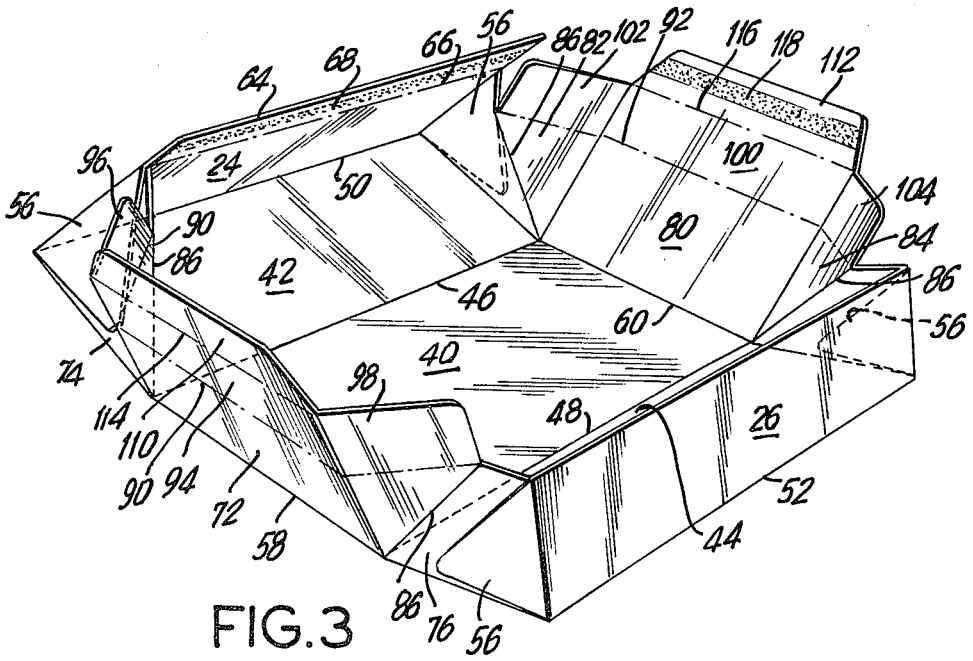
FIG. 3 is a perspective view of the new and improved tray of the subject invention after it has been partially folded to form a carton.
Figure 4:
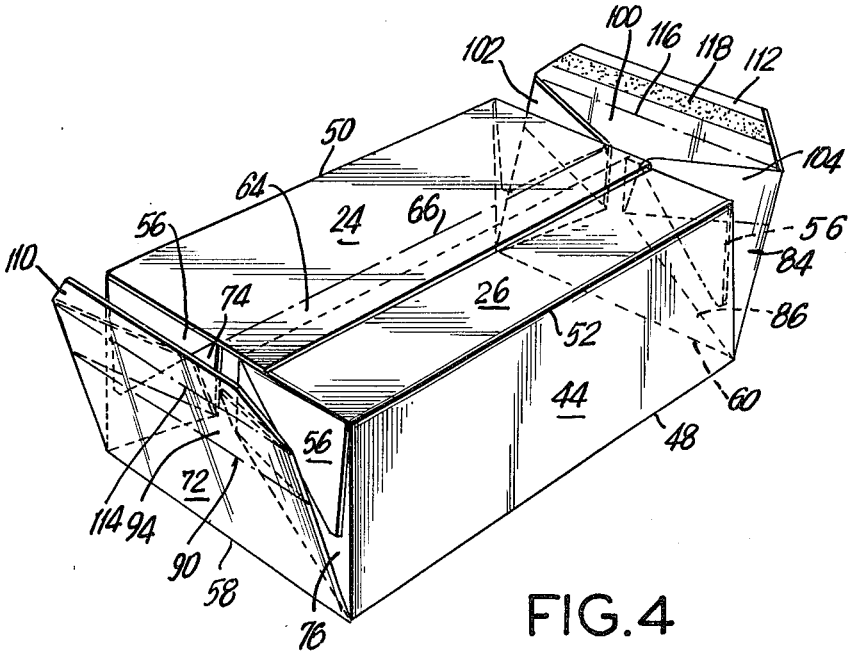
FIG. 4 is a perspective view of the new and improved tray of the subject invention in a subsequent folding step for forming the carton.
Figure 5:
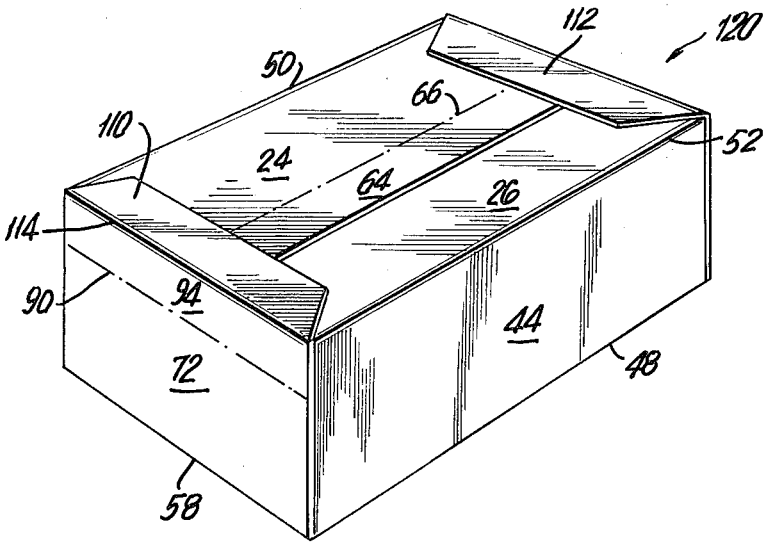
FIG. 5 is a perspective view of a tray of the subject invention in a collapsed configuration defining the closed carton.

In use, the blank 10 of the subject invention is erected into a tray configuration substantially as shown in FIG. 2, whereupon a product can be loaded therein. Thereafter, the tray 20 may be collapsed, as illustrated in FIGS. 3 and 4, to achieve the enclosed carton 120, as illustrated in FIG. 5. The package 120 is intended to be shipped and sold in the enclosed condition, such that the consumer may open the package and unfold it to reform the tray 20 such that it can be used for cooking or serving.

Tray 20 is erected from blank 10 by rotating side panels 28 and 30 into an upstanding orientation, perpendicular to bottom wall 22. Thereafter, end panels 24 and 26 are similarly rotated into an upstanding orientation such that glue tabs 54 can be adhesively connected to the adjacent side panels as illustrated in FIG. 2. During the initial erection of the collapsible tray, handle flanges 32, 34 are retained in an upright position to facilitate the collapsing of the carton. As discussed more fully hereinbelow, when the tray is reopened for use, the handle flanges are rotated outwardly, as illustrated in FIG. 2, defining carrying handles and structurally rigidifying the tray 20.

After the tray 20 has been erected, the manufacturer will load a product therein prior to collapsing the tray. Tray 20 is collapsed by rotating bottom panels 42 and 44 of bottom wall 22 upwardly, about fold lines 46 and 48 respectively. Simultaneously, side walls 28 and 30 are partially rotated outwardly, about fold lines 58 and 60. As the upward rotation of bottom panels 42 and 44 continues, the side panels begin to reverse their direction and fold back inwardly, with the side sections (74, 76, 82, 84) thereof being rotated about their respective diagonal fold lines 86 into an overlapping double-ply configuration.

After the bottom panels have been fully rotated, as illustrated in FIG. 4, the end panels 24 and 26 are disposed in overlapping coplanar relationship, parallel to the central portion 40 of bottom wall 22. By this arrangement, the end panels cooperate to define a continuous top wall, while the bottom panels 42 and 44 now define a side wall structure. Glue flap 64, provided on one of the end panels, can then be adhesively connected to the other end panel thereby securing the top cover of the carton.

The closing of the carton is completed by rotating center sections 72, 80 of the side panels into abutting relationship with the side edges of the carton 120. As illustrated in FIGS. 4 and 5, the side sections (74, 76, 80, 84) overlap and cooperate with the center sections to define a triple-ply end wall configuration having great strength and providing a water tight seal. Glue flaps 110 and 112 of handle flanges 32, 34 are rotated into coplanar relationship with the top wall and adhesively connected thereto. The resulting sealed carton 120, as illustrated in FIG. 5, may then be stored, shipped and sold to the consumer with the product housed therein.

When the consumer wishes to use the product, the carton is readily opened and reformed into the tray structure 20 for use in cooking or serving. More specifically, adhesive connections between the glue flaps 64, 110 and 112 and the associated panels are first broken. Thereafter, the carton 120 can be unfolded, by reversing the folding procedure, wherein side panels 28 and 30 are rotated outwardly and bottom panels 42 and 44 are rotated into coplanar relationship with central panel 40 to redefine bottom wall 22. In order to maintain the tray in its open configuration, handle flanges 32, 34 are rotated outwardly, away from the interior of the tray about fold lines 90 and 92, as illustrated in FIG. 2. The outward folding of the flanges effectively locks the tray in the open configuration since rotation of the side panels and handle flanges about fold lines 46 and 48 is substantially inhibited. Since rotation about fold lines 46 and 48 is effectively prevented, side panels 28 and 30 cannot be folded outwardly, which in turn prevents the upward folding of bottom panels 42 and 44. Conveniently, the outwardly extending flanges can be used as handles to facilitate the carrying of the tray during use. The buyer may then place the food stuffs within the open tray 20 for serving or cooking.

Accordingly, there has been described a new and improved collapsible tray and blank therefor which may be folded and shipped in an enclosed carton configuration and thereafter opened by the consumer into a tray configuration for serving or cooking. More particularly, a collapsible tray has been disclosed having a rectangular bottom wall 22 including a center panel 40 and opposed bottom panels 42, 44. The tray further includes two opposed pairs of end and side panels connected to the side edges of the bottom wall. Each side panel 28, 30 includes a center section 72, 80 and a pair of opposed side sections (74, 76, 82, 84), with each side section having a diagonal fold line 86 located therein. A pair of handle flanges 32, 34 are connected to the opposed side edges of each side panel for structurally rigidifying the tray. In use, the tray may be collapsed into a carton by upwardly folding the bottom panels relative to the center panel such that the bottom panels define the side walls of the enclosed carton and the end panels cooperate to define a continuous top wall. Further, each side section is folded inwardly about its diagonal fold lines such that the side sections and the center section of each side panel cooperate to define a triple-ply end wall structure. The carton may be readily opened and reformed into the tray configuration for serving or cooking.

It is to be understood that while the invention has been described with reference to a preferred embodiment, various changes and modifications may be made therein by one skilled in the art without varying from the scope or spirit of the subject invention as defined by the appended claims.

What is claimed is:

1. A collapsible tray comprising:

a generally rectangular bottom wall having a rectangular center panel and first and second rectangular bottom panels hingedly connected to opposed side edges of said center panel;

first and second upstanding end panels hingedly connected to the side edges of said bottom panels opposed to the hinged connections to said center panel;

first and second upstanding side panels hingedly connected to the remaining opposed side edges of said bottom wall, with the adjacent side edges of said end panels and said side panels being respectively hingedly connected to define a continuous side panel structure, each said side panel having a center section disposed co-extensive with and hingedly connected to the adjacent side edge of said center panel and with each said side panel further including first and second side sections hingedly connected to the opposed side edges of the associated center section and disposed co-extensive with and hingedly connected to the adjacent side edges of the first and second bottom panels, each said side section of said side panels including a diagonal fold line extending from the intersection between said side section and said center panel of said bottom wall; and a pair of handle flanges, respectively hingedly connected to the opposed side edges of said side panels, each said handle flange capable of being rotated at an angle relative to said side panel and extending away from the interior of said tray, said handle flanges thereby providing a means for carrying said tray and for rigidifying said tray, said tray being collapsible into an enclosed carton by upwardly folding said bottom panels of said bottom wall relative to said center panel thereof such that said bottom panels define side walls of said enclosed carton and said end panels cooperate to define a continuous top wall, and with each said side section being folded inwardly about said diagonal fold line such that said side sections and said center section of each said side panel overlap to define a triple ply end wall structure, whereby an enclosed carton is defined.

2. A collapsible tray as recited in claim 1 wherein each said handle flange includes a center portion disposed coextensive with and hingedly connected to the associated side edge of said center section of said side panel, and with each said handle flange further including first and second side portions respectively hingedly connected to the opposed side edges of said center portion of said handle flange, and with each said side portion being hingedly connected to and extending along a portion of the side edge of the adjacent side section of said side portion.

3. A collapsible tray as recited in claim 2 wherein said side portions of each said handle flange extend along the side edge of the adjacent side section of said side panel to a point coincident with the opposed end of said diagonal fold line thereof.

4. A collapsible tray as recited in claim 2 wherein each of said handle flanges further includes a glue flap hingedly connected to the remaining side edge of said center portion whereby when said tray is collapsed into said enclosed carton, said glue flap is connectable to said top wall for maintaining said end wall structure.

5. A collapsible tray as recited in claim 1 wherein one of said end panels further includes a glue flap hingedly connected to the opposed side edge thereof such that when said tray is collapsed into said enclosed carton, said glue flap of said one end panel is connectable to the other end panel to seal said carton.

6. A blank for forming a collapsible tray comprising:

a generally rectangular bottom wall having a rectangular center panel and first and second rectangular bottom panels hingedly connected to opposed side edges of said center panel;

first and second end panels hingedly connected to the side edges of said bottom panels, opposed to the hinged connections to said center panel;

first and second side panels hingedly connected to the remaining opposed side edges of said bottom wall, each said side panel having a center section disposed coextensive with and hingedly connected to the adjacent side edge of said center panel and with each said side panel further including first and second side sections hingedly connected to the opposed side edges of the associated center section and disposed coextensive with and hingedly connected to the adjacent side edges of said first and second bottom panels, each said side section of said side panels including a diagonal fold line extending from the intersection between said side section and said center panel of said bottom wall; and a pair of handle flanges hingedly connected to the opposed side edges of said side panels.

7. A blank as recited in claim 6 wherein each said handle flange includes a center portion disposed coextensive with and hingedly connected to the associated side edge of said center section of said side panel, and with each said handle flange further including first and second side portions respectively hingedly connected to the opposed side edges of said center portion of said handle flange, each said side portion being hingedly connected to and extending along a portion of the side edge of the adjacent side section of said side panel.

8. A blank as recited in claim 7 wherein each said side portion of said handle flanges extends along the side edge of the adjacent side section of said side panel to a point coincident with the opposed end of said diagonal fold line thereof.

9. A blank as recited in claim 7 wherein each of said handle flanges further includes a glue flap hingedly connected to the remaining side edge of said central portion.

10. A blank as recited in claim 6 wherein one of said end panels further includes a glue flap hingedly connected to the opposed side edge thereof.

11. A blank as recited in claim 6 wherein each said end panel further includes a pair of glue tabs disposed along the side edges thereof hingedly connected along a line colinear with the hinged connections between said bottom wall and said side panels.

* * * * *